US005450077A

United States Patent [19]

Tyburski

[11] Patent Number: 5,450,077

[45] Date of Patent: * Sep. 12, 1995

[54] ROADWAY SENSOR SYSTEMS

[75] Inventor: Robert M. Tyburski, Silver Spring, Md.

[73] Assignee: Mitron Systems Corporation

[ * ] Notice: The portion of the term of this patent subsequent to Sep. 5, 2012 has been disclaimed.

[21] Appl. No.: 925,694

[22] Filed: Aug. 7, 1992

Related U.S. Application Data

[63] Continuation-in-part of Ser. No. 880,410, May 8, 1992, which is a continuation-in-part of Ser. No. 406,345, Sep. 13, 1989, abandoned, which is a continuation-in-part of Ser. No. 346,685, May 3, 1989, abandoned.

[51] Int. Cl.[6] ..... G08G 1/01

[52] U.S. Cl. ..... 340/933; 200/86 A; 340/941

[58] Field of Search ..... 340/933, 939, 941, 936, 340/934; 364/436; 404/17, 32; 116/63 R; 377/9; 200/86 R, 86 A; 310/330, 338, 800

[56] References Cited

U.S. PATENT DOCUMENTS 4,383,239 5/1983 Robert ..... 340/933
5,008,666 4/1991 Gebert et al. ..... 340/933
5,245,334 9/1993 Gebert et al. ..... 340/933

FOREIGN PATENT DOCUMENTS 0287250 10/1988 European Pat. Off. ..... 340/933
2123795 12/1972 Germany ..... 340/941

*Primary Examiner*—Brent Swarthout
*Attorney, Agent, or Firm*—Jim Zegeer

[57] ABSTRACT

A linear roadway vehicle sensor for sensing vehicular traffic thereover includes a flexible carrier member comprising an elongated flat elastomeric member having upper and lower surfaces, a recess formed in the lower surface. The recess has a first top surface and a linear weight is distributed along the length of the flexible carrier. An adhesive secures the linear weight in the recess in said flexible carrier. The weight has a second top surface and a weight per unit length which is sufficient to maintain the sensor on said roadway and substantially immune to lifting from the roadway because of air flow effects and turbulence caused by vehicles, and one or more sensor grooves formed in the top surfaces and an elongated sensor in the one or more sensor grooves and between the elastomeric member and the linear weight means.

27 Claims, 4 Drawing Sheets

FIG. 1a
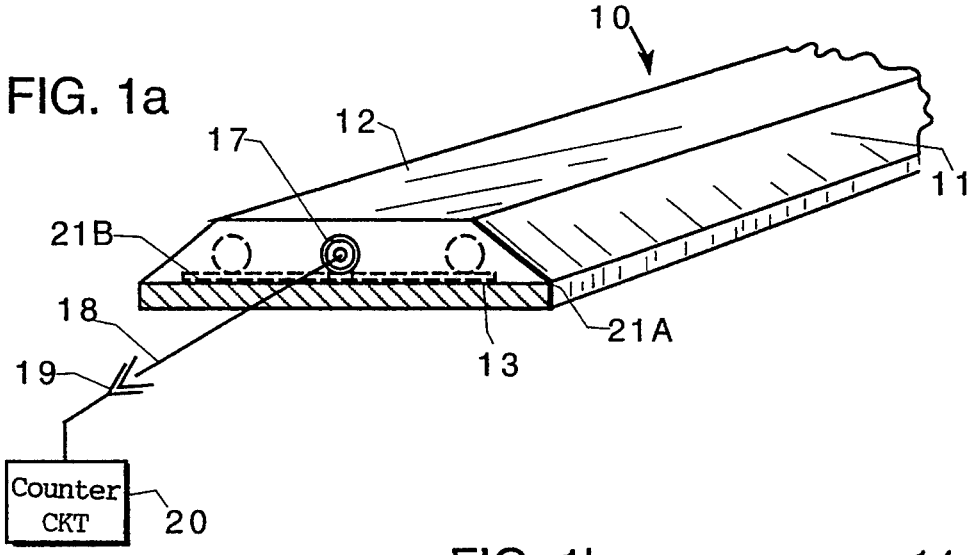
FIG. 1b
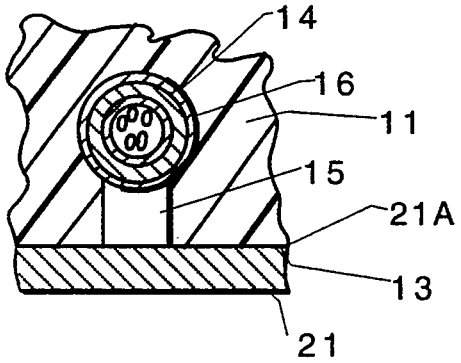
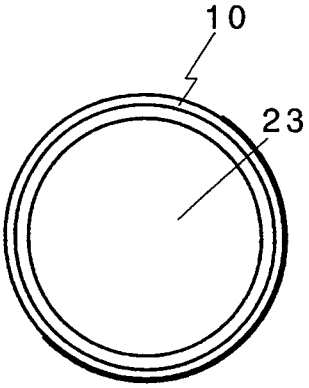
FIG. 1c
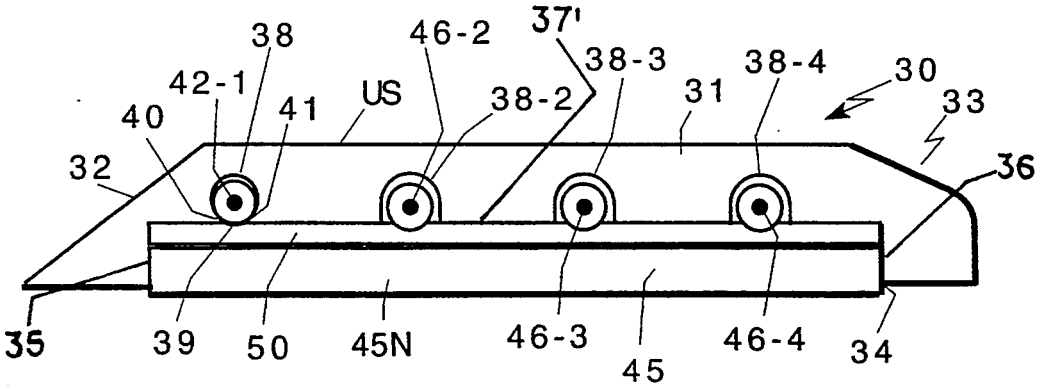
FIG. 2

ROADWAY SENSOR SYSTEMS

REFERENCE TO RELATED APPLICATIONS

This application is a continuation-in-part of my application Ser. No. 07/880,410 filed May 8, 1992 entitled "ROADWAY SENSOR SYSTEMS", which, in turn, is a is a continuation-in-part of my application Ser. No. 406,345 filed Sep. 13, 1989 entitled "ROADWAY SENSORS AND METHOD OF INSTALLING SAME", now abandoned, which was, in turn, a continuation-in-part of my application Ser. No. 07/346,685 filed May 3, 1989 entitled "ROADWAY SENSORS AND METHOD", now abandoned, which are incorporated herein by reference.

BACKGROUND AND BRIEF DESCRIPTION OF THE INVENTION

In my above-identified application Ser. No. 406,345, I disclose roadway sensors in which a piezoelectric sensor is carried within an envelope and a linear weighting member is substantially coextensive with the sensor to maintain the sensor on the roadway despite being traversed by heavily loaded trailer trucks traveling at high speeds generating trailing air turbulences having the effect of sweeping the roadway. The weight member is uniformly distributed along the roadway portions of the sensor strip to maintain the sensor on the roadway and substantially immune to air effects generated by vehicular traffic on the roadway, such as a loaded truck trailer traveling at high speeds. Preferably the weight is a flat malleable metal such as a lead strip having a weight of about one pound per linear foot. For lower speed roadways and/or roadways restricted to smaller or lighter vehicles (which cause less air flow effects) a lower distributed weight can be used, for example, one-half pound per linear foot of sensor.

Since the weight member, in a preferred embodiment, is a strip of lead, preferably flat for low vertical profile purposes, and since roadways are not flat, e.g., road surfaces wear and wide grooves develop over time and create a cavity or groove where the wheels travel, the flat malleable lead strip adapts to such cavities and undulations and curvatures in the roadway and hugs the surface so that the sensor does not bounce and oscillate for a long period of time as would be the case if the sensor were mounted on a rigid member, such as a rigid steel strip. During the period of time when the rigid steel strip is vibrating, the sensor output signal would mask legitimate pulses from a tire of a closely spaced axle, for example.

The weighted sensor systems disclosed in my above-identified applications monitors a variable number of lanes simultaneously, preferably from one to six lanes or more. In a worst case situation, six lanes, this would require 12 feet times 6 equals 72 feet, plus 8 feet for the shoulder or an 80 foot length. With a rigid steel base member, this would be difficult to install in the field. In my above-identified applications, I teach that the sensor is maintained essentially motionless when a vehicle is traversing the sensor if the linear weight is sufficient to avoid movement effects due to air flow generated by the moving vehicle. Large trucks with wide square backs are one of the worst. As discussed above, experience has demonstrated that a weight of one pound per foot is good for traffic up to speeds of about 85 mph. In order to achieve this weight, a 2" wide piece of lead 3/32" thick is glued to a five ounce per foot elastomeric or rubber carrier. The completed assembly is approximately one pound per foot. In contrast, because the specific gravity of steel is approximately 7.89, and that of lead is 11.35, the steel would need to be thirty percent thicker than lead (0.093" vs. 0.121"). This thicker steel would make the handling of a long sensor very difficult and cause the strip to vibrate as discussed above and, therefore, an integral steel strip is not able to perform according to the invention.

The present invention adapts this distributed weight concept of my earlier above-identified applications and, in addition, provides a unique sensor carrier which is both coilable and reusable and refurbishable and adaptable to wide varieties of roadway conditions and is easily adaptable to multiple lane roadways.

According to one embodiment of the invention, a carrier made of an extruded or molded roadway rubber (such as Neoprene, etc.) is provided with one or more sensor carrying grooves and, depending on the number of lanes of roadway traffic to be sensed, a plurality of parallel signal conductor carrying grooves. In a preferred embodiment, the sensor carrier has an upper surface which is ramped and a lower surface in which are formed a cavity or recess for receiving the weight and has a cross-section corresponding to the cross-section of the weight. In this embodiment, the top surface of the cavity is provided with sensor receiving grooves and coaxial signal conductor receiving grooves. In a preferred embodiment, the sensor receiving grooves are lipped whereas the coaxial signal conductor receiving grooves are deeper and U-shaped. A flat weight member is secured in the cavity or recess to the lower surface of the carrier (the top surface of the cavity), preferably by an adhesive such as a double-faced tape. The weight is lead, it is preferably provided with a protective overcoat, such as a flexible polymer coating. A layer of nylon reinforced tape is adhered to the bottom surface of the lead strip which makes contact with the road. An important feature of this assembly is that it is able to adapt to curvature and undulations in the roadway and hug the roadway surface in such a way as to eliminate or minimize extraneous signals caused by the sensor being bounced up and down on the roadway by traffic and/or by aerodynamic effects caused by high speed heavy vehicular traffic thereover.

In some cases, coaxial cable can have a piezoelectric effect, and enlarged coaxial cable grooves disclosed herein mitigate this effect.

In further embodiments, to protect the lead strip the cavity is formed as a totally enclosed passage or aperture in the elastomeric carrier and the lead weight, with a protective polymer plastic overcoat and lubricated with a solid lubricant such as Teflon TM is inserted into the cavity. As a further embodiment, the underside of the elastomeric carrier can be slit to enable easy insertion of the lead strip in the enclosed cavity.

The carrier/sensor of the present invention has the following benefits over road tubes and other prior art systems:

(a) Conforms to and hugs roadway surface;
(b) Simultaneous multiple individual lane sensing;
(c) Adjustable, ideal for driveway and turning movement studies;
(d) Excellent for speed, volume and classification sensing;
(e) Eliminates the need for a mechanical air switch;

(f) Eliminates recording failures due to pin hole air leaks in road tube;

(g) Eliminates recording failures due to water in the road tube;

(h) Eliminates recording failures due to nails coming loose due to high tension stretch on the road tube;

(i) Greater accuracy;

(j) Safe, quick installation; and (k) Rugged, long lasting and reusable.

Traffic engineers throughout the world have been seriously hampered in their efforts to perform volume, speed and classification studies when road tubes are utilized for input to their traffic recorders. The portable over the pavement piezoelectric polymer sensor and method disclosed herein offers the traffic engineer a means of generating electrical impulses when the vehicle's axle traverses the sensor assembly. This invention provides the traffic engineer volume, speed and classification data which would be virtually impossible to record with existing road tubes. Using this method also enables the traffic engineer to field install the piezoelectric sensor assembly in inclement weather on the roadway and to adjust its active detection area to the requirements of the data capture application. An important advantage of this coilable, removable and reusable sensor is its safety and ease of installation. There is no need to dart in and out of traffic attaching clamps or adhesive tape at different points in order to stabilize the sensor. Its rugged construction and wide temperature operating range make it ideal for slow and fast moving traffic in extremely wet or dry weather conditions.

DESCRIPTION OF THE DRAWINGS

The above and other objects, advantages and features of the invention will become more apparent when considered with the following specification and accompanying drawings wherein:

FIG. 1*a* is a sectional and isometric view of a roadway sensor disclosed in my above-identified application Ser. No. 07/880,410, FIG. 1*b* is an enlarged view of a sensor carrying groove portion of FIG. 1*a*, FIG. 1*c* shows the assembly of FIG. 1*a*, coiled on a form for transportation, FIG. 2 illustrates a preferred embodiment of the present invention.

DETAILED DESCRIPTION OF THE INVENTION

Figure 3:
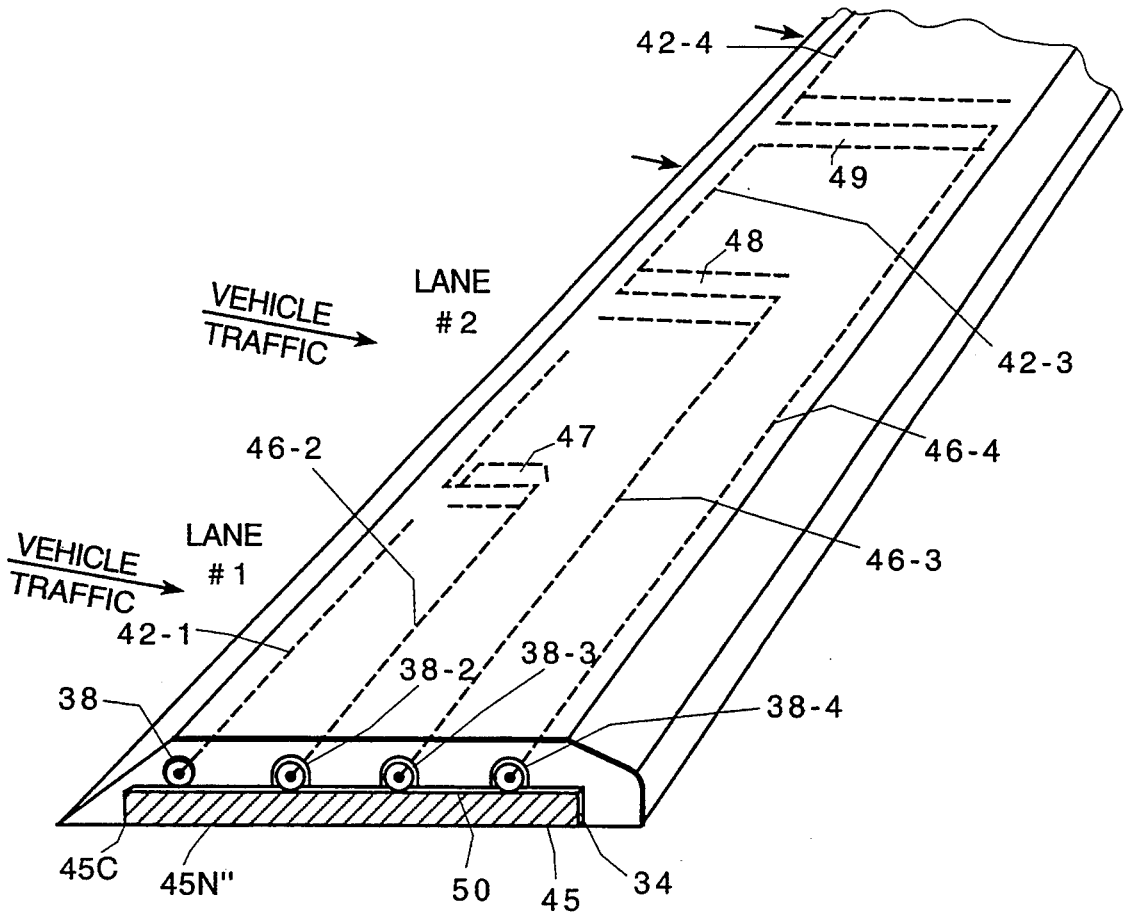
FIG. 3 is an isometric view of the embodiment shown in FIG. 2 on a multi-lane roadway.

A basic construction from application Ser. No. 07/880,410 is illustrated in FIG. 1*a* wherein a roadway sensor assembly 10 is comprised of an extruded flat elastomeric carrier 11 having an upper surface 12 which may be ramped to better accommodate tire forces and a flat planar lower surface 13. Lower surface 13 is provided with sensor groove 14 which has a narrow mouth 15 and an enlarged sensor carrying portion 16. Mouth 15 has sidewalls which can be spread apart sufficiently to allow the sensor cable to be snugly seated in the enlarged base 16 and then spring back to snugly enclose the sensor in retention position. A piezoelectric sensor cable assembly 17 is carried in sensor groove 14. Piezoelectric sensing cable assembly 17 can be of the type manufactured by Atochem Corporation of Norristown, Pa. In such cables, a piezoelectric plastic polymer such as KYNAR TM, is provided with sensing electrodes (not shown) which are connected to a flexible coaxial cable 18, which can be encased in a protective envelope. Other forms of sensor cables are shown in my above-identified application Ser. No. 07/880,410.

The coaxial cable 18 has a conventional signal cable connector 19 for secure electrical connection or coupling of analog signals generated by vehicular traffic to recorder and counter circuit 20 of the type disclosed in U.S. Pat. No. 4,258,430 for example, owned by the assignee hereof.

The carrier 11 with piezoelectric sensor cable assembly 17 installed and snugly seated in groove portion 16 has a linear weight 21 secured, preferably by a flexible adhesive 21A, to the lower surface 13 of flat carrier 11. Weight 21 can be of a type disclosed in my above-identified applications, and preferably is a flat malleable metal strip made of lead, for example. The weight and the carrier have a weight per unit length of at least about one pound per foot for heavily traveled high speed highways. For three twelve foot roadways, this amounts to about 36 pounds. For lower speed roadway uses, the weight can be less as disclosed above and in my above-identified applications.

As shown in FIG. 1*c*, the sensor assembly 10 is coilable on a form 23 so that it can be easily unrolled upon a roadway. The weight will cause the sensor assembly to hug the roadway and because the lead is malleable, roadway traffic will cause the assembly to closely conform to the roadway surface including roadway undulations.

THE PRESENT INVENTION

Referring now to FIG. 2, sensor carrier 30 includes an extruded, flexible member 31 having a ramped or sloped leading (up road) edge 32 which is engaged first by the vehicle tires and a slightly chamfered or beveled trailing edge 33. Member 31 is made of a conventional roadway grade elastomeric material such as tough Neoprene rubber, or the like. The dimensions are exemplary and FIG. 2 is slightly enlarged. The lower surface of member 31 has a rectangular cavity or recess 34 which has leading, up-road or upstream wall 35 and trailing down-road or downstream wall 36 and an upper surface 37'.

Sensor groove 38 has a mouth 39 defined by lips 40 and 41, which, in conjunction with the dimension of the piezoelectric sensor 42, is adapted to snugly retain the sensor in position on the up-road or leading edge of linear weighting member 45. A layer of nylon reinforced tape 45N is adhered to the bottom surface of the lead strip which makes contact with the roadway surface.

It has been found that when the piezoelectric sensor is on the leading edge or within ½ inch of the leading or upstream edge of the lead weight 45 in the unit, impact measurements of the tire are most accurate and least susceptible to being masked by subsequent effects of the vehicle suspension and/or rebound as the tire moves over the unit. The piezoelectric sensor cable can be so sensitive that even with the extremely low vertical profile (0.375 inch), effects of the vehicle suspension can be detected and ambiguities can be eliminated or minimized by placement of the sensor cable as close to the leading edge of the unit as is practicable.

As shown in FIG. 3, the unit is designed for a multiple lane roadway. In this case, sensor groove 38 contains four sensors aligned in groove 38 and spanning the individual lanes: piezoelectric sensor 42-1 for lane number #1, piezoelectric sensor 42-2 for lane number #2, piezoelectric sensor 42-3 for lane number #3, and piezoelectric sensor cable 42-4 for lane number #4. Each piezoelectric sensor cable may have a connector (not shown) for connection to a coaxial cable leading to an electronic counter and/or analyzer of the type referred to above in connection with FIG. 1. Piezoelectric sensor 42-2 is connected to coaxial cable 46-2 which is carried in U-shaped coaxial cable groove 38-2, piezoelectric sensor 42-3 is connected to coaxial cable 46-3 in U-shaped groove 38-3 and piezoelectric sensor 42-4 is connected to coaxial cable 42-4 in groove 38-4, crossover cut-outs 47, 48 and 49 enable the coaxial cable to be fitted into their respective grooves.

Some coaxial cables have insulator portions which may have significant piezoelectric properties, and to mitigate or minimize inducing piezoelectric potentials in the coaxial signal carrying cables or wires, the grooves 38-2, 38-3 and 38-4 are made "U" shaped and slightly deeper so that significantly less of pressure on the elastomeric member is transmitted to these coaxial cables. In contrast, it will be noted that the piezoelectric sensor cables 42-1, 42-2, 42-3 and 42-4 are relatively snug in groove 38 so that the effect of the pressure on the upper surfaces US of member 31 are effectively transmitted to the piezoelectric sensors while in contrast, in regards to the coaxial signal carrying cables, the U-shaped grooves 38 provide a small air space above the cable to prevent or mitigate piezoelectric voltages being induced in the coaxial cables.

Lead weight member 45 is provided with a protective flexible polymer coating 45C to prevent spalling and oxidation of lead strip 45. Weight 45 is adhesively secured in the recess or cavity 34 by adhesive, preferably a double-faced adhesive tape 50.

WEIGHT-IN-MOTION

Another use for this sensor assembly of this invention is the utilization of the sensor's ability to generate different amplitude pulses based on the weight of the vehicle's axle(s). using the weight information in conjunction with axle spacings results in obtaining a more refined selection of vehicles when vehicles exhibit similar axle spacing characteristics, e.g. truck with a trailer versus a car with a boat. Electronic circuitry in the recorder would quantify the energy (e.g. weight and speed) in the pulse in order to distinguish between a car and a truck which normally has a weight difference of 2–6 times. This resultant data would become part of the classification software algorithm used within the recorder to separate vehicle types for accumulation and storage in memory.

POLLED SENSOR CABLE

The sensor assembly could be assembled using a polled sensor cable as opposed to a separate sensor and a separate coax cable. The use of a polled sensor cable has the advantage of eliminating the need of making a mechanical connection between the sensor and the coax cable. The polled sensor cable is a single piece of cable with an active area of approximately 8 feet and an inactive area to carry the signal to the recorder of approximately 100 to 200 feet. Another advantage in using the polled sensor cable would be quicker assembly due to the sensor and cable being in their own groove. In such case, in FIGS. 2 and 3 the grooves 382, 38-3 and 38-4 are made similar to sensor groove 38.

Although the preferred embodiment of the invention refers to a piezoelectric cable as the sensor element, piezoelectric film, as disclosed in my application Ser. No. 346,685, could be used as the sensor element. The advantages of construction on a single substrate would be a much lower profile and shorter assembly time. The disadvantage would be the pre-designated fixed active sensing area of the assembly. In this case, individual wafers of film could be utilized to preserve the lower profile at the expense of making the assembly wider.

SPEED MEASUREMENT

The invention can also be used to make speed measurements. A pair of spaced sensor grooves, aligned in a given lane can be used to measure speed of a vehicle in the manner disclosed in Dixon application Ser. No. 07/880,638 entitled "VEHICLE SPEED MEASUREMENT APPARATUS", and assigned to the assignee hereof.

Traffic engineers throughout the world have been seriously hampered in the efforts to perform volume, speed and classification studies when road tubes are utilized for input to their traffic recorders. The piezoelectric sensor disclosed herein offers the traffic engineer a means of generating electrical impulses when the vehicle's axle traverses the sensor assembly. This invention provides the traffic engineer volume, speed and classification data which would be virtually impossible to record with existing road tubes. Using this method also enables the traffic engineer to field install the piezoelectric sensor assembly in inclement weather on the roadway and to adjust its active detection area to the requirements of the data capture application.

There are definite advantages in not having to glue, tape or nail the sensor to the roadway. As noted above, experience has shown that tape and glue do not stick to moist or wet roads. Nailing the assembly in place is time consuming, therefore, for safety purposes, vehicles would need to be redirected for a short period. This redirection of traffic is usually done only for serious road repair work, not sensor placement work.

Figure 4:
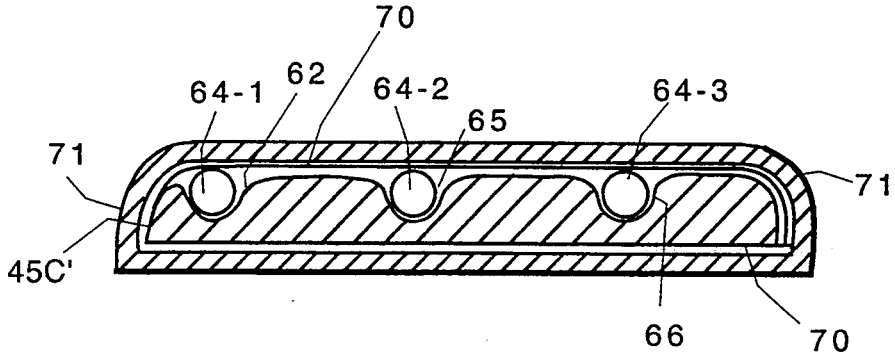
FIG. 4 is a cross-sectional view of a further modification of the invention.
Figure 5:
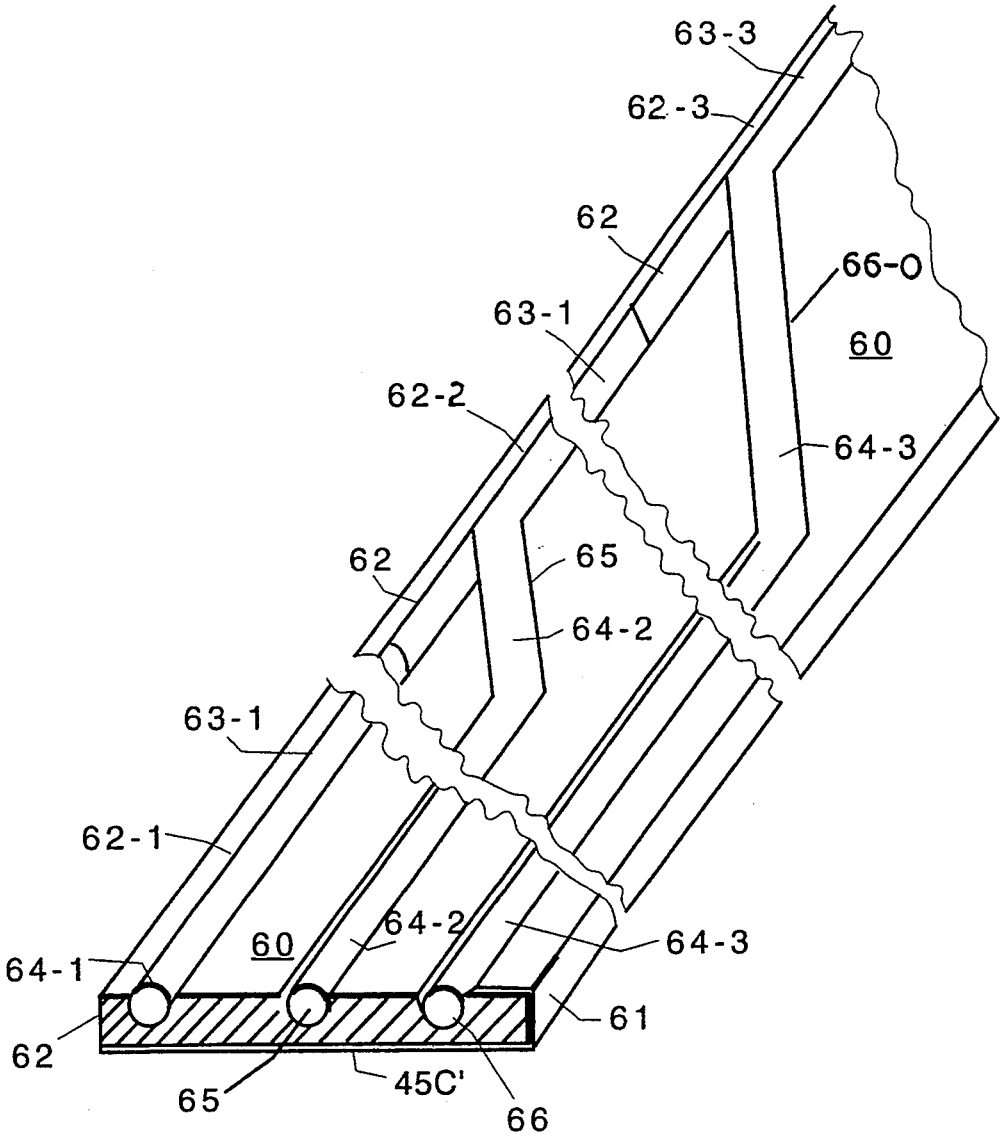
FIG. 5 is an isometric view of the lead carrier and sensor, coaxial cable groove pattern in the lead weight shown in FIG. 4.

In the embodiment illustrated in FIGS. 4 and 5, the sensor positioning grooves and coaxial cable grooves are formed in the upper surface 60 of the lead weight member 61. Flexible protective polymer coating 45C' prevents erosion and spalling of the lead. Sensor groove 62 has a first portion 62-1 for receiving a polled sensor cable 63-1 having an integrally connected coaxial cable 64-1 which is connected to electronic recording and analyzing circuitry shown in FIG. 1. Similarly, sensor groove 62 has a second portion 62-2 and third portion 62-3 for receiving piezoelectric sensors 63-2 and 63-3, respectively, which may be polled and have integrally connected coaxial cables 64-2 and 64-3 in grooves 65 and 66, respectively. Groove 65 has an off-set portion 65-0 in which the coaxial cable 64-2 is seated and, likewise, groove 66 has an off-set portion 66-0 in which is seated coaxial cable 64-3. Grooves 65 and 66 may be slightly deeper than groove 62 to minimize piezoelectric voltages being induced in the coaxial cable portions of the assembly. A foam cushion (not shown) may be positioned and adhered over the coaxial cable portions to further minimize inducing voltages as in the coaxial signal carrying cables. Because the lead metal is relatively soft and malleable, the grooves for sensors and coaxial signal cables can be easily embossed or formed into the upper surface.

A retaining sheath 70 can be applied either as a shrink fitted plastic member or as a conformal coating, to retain the sensors and coaxial cables in their respective grooves and serve as a further protective layer for the lead strip. Finally, a road-grade elastomeric envelope 71 such as Neoprene rubber is applied. Envelope 71 can be extruded on the assembly shown in FIG. 5 after application of retaining conformal member or protective layer or coating 70, or be one or two strips of road-grade elastomer, such as Neoprene, glued together along one edge to form the envelope (one strip) or glued along two edges (for two strips). One important advantage of this embodiment is that it has a very low vertical profile.

The assembly can be coiled on a coil form such as shown in FIG. 1, for rapid dispensing onto a roadway and rapid retrieval from a roadway.

Figure 6:
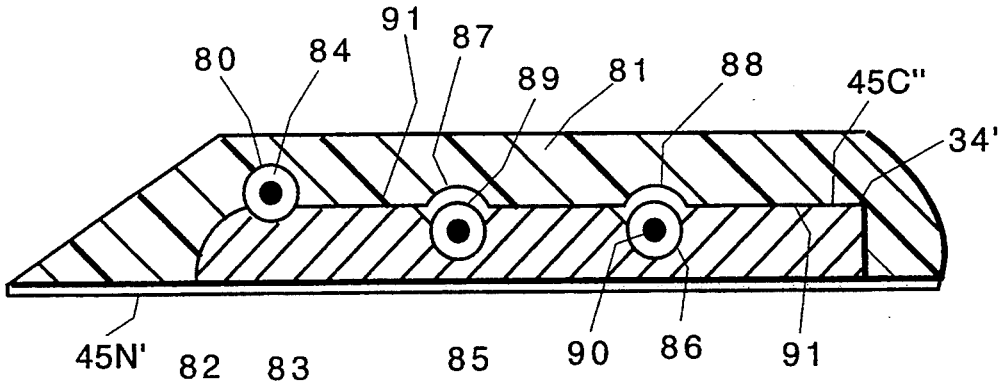
FIG. 6 illustrates a further embodiment of the invention.

In the embodiment shown in FIG. 6, the grooves are partially in the elastomeric member and partially in the lead weight member 83, which has a protective polymer plastic covercoat 45C''. Note that the sensor groove 80 in the elastomeric member 81 and, sensor groove 82 in the weight member 83 retain sensor 84 in very precise fixed positions on the lead weight. Coaxial cable grooves 85 and 86 in lead weight 83 are deep and cooperating grooves 87 and 88 in elastomeric member 81 coact to minimize the generation of voltages in coaxial cables 89 and 90. An adhesive 91 retains the lead weight 83 in recess 34'.

Figure 7:
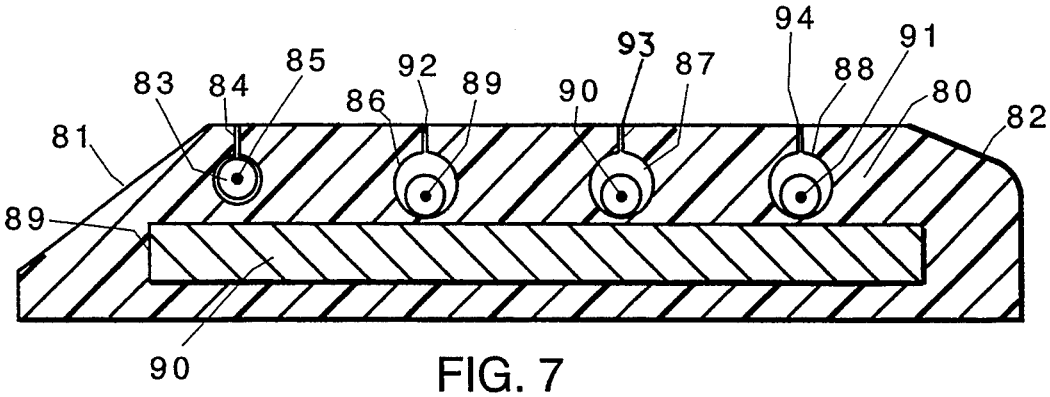
FIGS. 7–10 illustrate further embodiments of the invention.

In the embodiments of FIGS. 7–10 (shown in section) a totally enclosed cavity passage or space is provided in the elastomeric strip and the lead weight with or without a protective polymer over-coat, with or without a lubricant, is inserted into the cavity passage or aperture. Referring to FIG. 7, extruded elastomeric carrier strip 80 has a ramped leading or up-road edge 81 which is first engaged by the vehicle wheels, a chamfered trailing or down-road edge 82 and elongated sensor bore 83 with a slit 84 allowing sensor cables 85 (if desired, one for each lane of the multi-lane roadway) to be inserted in bore 83. Bore 83 closely conforms to the outside diameter of the sensor cable 85. Coaxial signal cable bores or passages 86, 87 and 88 are connected to their respective piezoelectric sensors via short cross-over cut-outs (47, 48 and 49) in the elastomeric material between bores in the manner discussed above in connection with FIG. 3. Coaxial signal carrying cables 89, 90 and 91 are fitted into bores 86, 87 and 88, respectively. The dimensions are exemplary in FIG. 7. Note that bores 86, 87 and 88 are significantly larger than the coaxial signal cables 89, 90 and 91, respectively, to minimize inducing ambiguous voltages in these coaxial cables. Weight cavity, passage or aperture 89 is adapted to retain lead weight strip 90 which may have a protective polymer coating or a solid lubricant coating such as Teflon TM, optional slots 92, 93 and 94 facilitate fitting the coaxial signal cables in the respective grooves.

Figure 8:
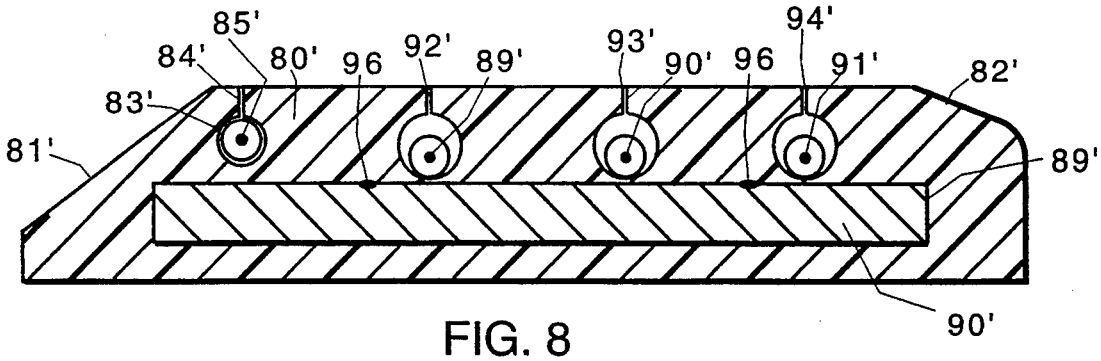
Figure 9:
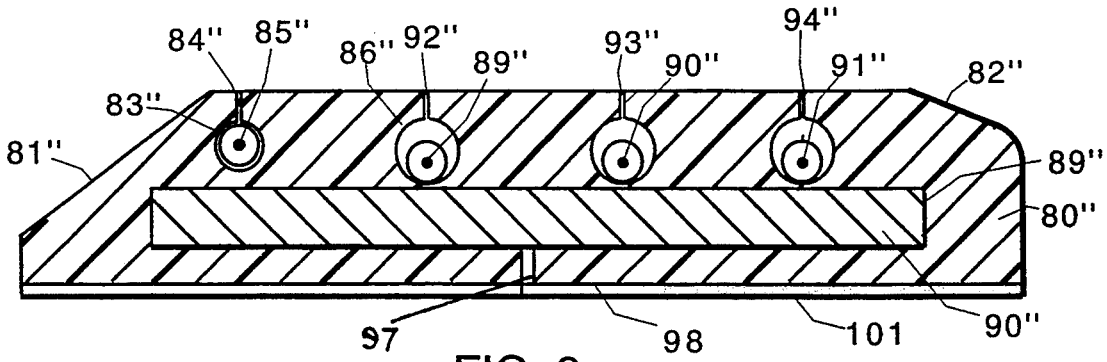
Figure 10:
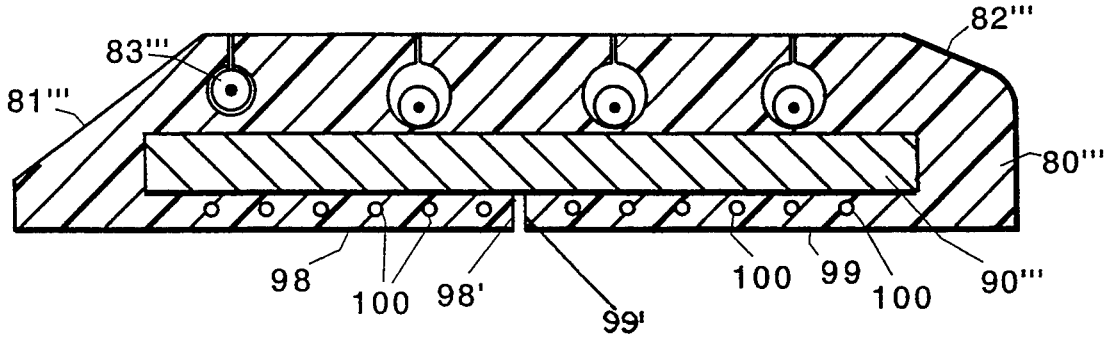

In the embodiments shown in FIGS. 8–10, like parts are provided with primed numerals.

In FIG. 8, the weight cavity 89' is provided with very shallow ribs 96 to reduce friction lengthwise and to facilitate introduction of the weight axially or lengthwise of the cavity 89. Note that ribs 96 are spaced a distance from the sensor bore 83 so that they do not interfere with the inducing of signals in sensor cable 85. In the embodiment shown in FIG. 9, the bottom portion 97 is slit as at 98 so that weight 90'' can more easily be introduced into weight cavity 89''. A reinforced nylon tape 101 is adhered to the roadside engaging surface of elastomeric carrier member 80''. In the embodiment of FIG. 10, the sides 9 and 99' to each side of slit 98' are strengthened with Kevlar TM strands 100.

While preferred and exemplary embodiments of the invention have been illustrated and described, it will be appreciated that various other modifications and adaptations of the invention will be apparent to those skilled in the art and it is intended that such modifications and adaptations be encompassed by the claims appended hereto.

What is claimed is:

1. In a linear roadway vehicle sensor for sensing vehicular traffic thereover, the improvement comprising, a flexible carrier member comprising an elongated flat elastomeric member having upper and lower surfaces, and a leading edge, a linear recess formed in said flexible carrier, linear weight means distributed along the length of said flexible carrier member and means securing said linear weight means in said recess in said flexible carrier member, said linear weight means having a weight per unit length which is sufficient to maintain said sensor on said roadway and substantially immune to lifting from the roadway because of air flow effects and turbulence caused by vehicles, said linear weight means being able to adapt to undulations and curvatures in said roadway and does not bounce up and down because of roadway traffic, and a sensor passage formed in said carrier and at least one elongated pressure sensor means carried in said sensor passage.

2. The invention defined in claim 1 wherein said elongated pressure sensor means has a length sufficient to sense multiple lanes of roadway traffic, said flexible carrier member, said recess and linear weight means having corresponding lengths, respectively.

3. The invention defined in claim 2 wherein said elongated pressure sensor means includes plural piezoelectric cable means, one for each lane of said roadway, and all of said sensors being carried in said sensor passage, said flexible carrier member having a groove therein, and at least one of said piezoelectric cable means has a shielded coaxial conductor connected thereto, said shielded coaxial cable extending to a side of the roadway in said groove.

4. The invention defined in claim 1 wherein said linear weight means is a flat lead strip and at least a portion of said groove is in said flat lead strip.

5. The invention defined in claim 1 wherein said sensor passage is positioned in said leading edge of said flexible carrier member.

6. The invention defined in claim 3 wherein said groove is dimensioned such that ambiguous signals induced in said coaxial conductor are minimized.

7. A linear roadway sensor for sensing vehicular traffic and a carrier for said sensor which is substantially immune to lifting from the roadway because of air flow turbulence caused by vehicles traveling at high speeds thereover, said carrier including a flat flexible elastomeric carrier member, a linear weight cavity formed in said carrier, a linear weight distributed along said flexible carrier member and received in said linear weight cavity, said linear weight having a weight at least sufficient to render said flexible carrier member substantially immune to air effects generated by vehicular traffic on the roadway, and to cause said flexible carrier to hug the roadway surface and not be dangerous to moving traffic or pedestrians even if snagged or broken by vehicular traffic and adhesive securing said weight in said cavity.

8. The invention defined in claim 7 wherein said flexible elastomeric carrier has a lower surface, a leading up-roadway edge, a trailing down-roadway edge and a centerline between the edges, a plurality of grooves in said lower surface, and said sensor being constituted by a plurality of said sensors, each sensor being constituted by a an electronic pressure sensitive cable carried in the one of said grooves upstream of said centerline and proximate said leading up-roadway edge.

9. A linear roadway sensor for sensing vehicular traffic and a carrier for said sensor which is substantially immune to lifting from the roadway because of air flow turbulence caused by vehicles traveling at high speeds thereover, said carrier including a flat flexible elastomeric carrier member having upper and lower surfaces and a leading edge, a linear weight cavity formed in said carrier, a linear weight distributed along said flexible carrier member and received in said linear weight cavity, said linear weight having a weight at least sufficient to render said flexible carrier member substantially immune to air effects generated by vehicular traffic on the roadway, and to cause said flexible carrier to hug the roadway surface and not be dangerous to moving traffic or pedestrians even if snagged or broken by vehicular traffic and adhesive securing said weight in said cavity, said flexible elastomeric carrier having a leading up-roadway edge and a trailing down-roadway edge and a centerline between the edges, a plurality of grooves in one of said surfaces and there are a plurality of said sensors, each sensor being constituted by a piezoelectric cable carried in the one of said grooves upstream of said centerline and proximate said leading edge, and wherein said linear weight is a flat lead strip.

10. A carrier for a roadway sensor for vehicles with tires comprising:

an extruded elongated elastomeric member having an upstream end and a downstream end, top and bottom surfaces and means forming a rectangular cavity in said elastomeric member, said rectangular cavity having a top wall surface and upstream and downstream sidewalls, said elastomeric member having at least one sensor passage for receiving a roadway sensor such that the vehicles traveling on said roadway activate said sensor, and means for retaining a linear weight means in said rectangular cavity.

11. A carrier for a roadway sensor for vehicles with tires comprising:

an elongated elastomeric member having an upstream edge and a downstream edge, top and bottom surfaces and means forming a rectangular cavity in said elastomeric member, said rectangular cavity having a top wall surface and upstream and downstream sidewalls, said elastomeric member having at least one groove for receiving a roadway sensor such that the vehicles traveling on said roadway activate said sensor, means for retaining a linear weight means in said rectangular cavity, and a linear weight means substantially filling said rectangular cavity, and wherein said at least one groove is positioned relative to said linear weight means such that it is within less than ½ inches of the upstream edge of said linear weight means.

12. The invention defined in claim 10 wherein said roadway is a multiple lane roadway and said carrier is at least long enough to span two adjacent lanes, and there is at least one roadway sensor for each lane of said roadway, respectively, with all said roadway sensors being carried in said sensor passage.

13. The invention defined in claim 11 wherein said sensor groove s constituted by opposed complementary groove portions in said elastomeric member and in said linear weight means.

14. A carrier for a roadway piezoelectric sensor cable comprising:

a flat lead strip having top and bottom surfaces and a weight sufficient to maintain said strip on the roadway in high speed truck traffic and at least one sensor receiving groove formed in said top surface, and a protective polymer over-coat on all external surfaces of said lead strip.

15. The carrier defined in claim 14, said carrier having an up roadway edge first engaged by truck wheels and down roadway edge including at least one further groove in said top surface, said at least one sensor receiving groove having a depth D1 and being located within one-half inch of said up roadway edge and said at least one further groove having a depth greater than D1.

16. A vehicle traffic sensor comprising the carrier defined in claim 14, a vehicle traffic sensor in said sensor receiving groove, and means for retaining said vehicle traffic sensor in said groove.

17. The vehicle traffic sensor defined in claim 16 wherein said means for retaining includes a plastic shrink wrap envelope enclosing said lead strip and said vehicle traffic sensor, and a roadway grade elastomeric envelope enclosing said plastic shrink wrap envelope, said lead strip and said vehicle traffic sensor.

18. A vehicle traffic sensor comprising the carrier defined in claim 15, one or more piezoelectric sensor cables seated in said sensor receiving groove, and retaining means for retaining said piezoelectric sensor in said sensor receiving groove.

19. A vehicle traffic sensor as defined in claim 18 wherein there are at least two piezoelectric sensor cables in said sensor receiving groove, a cross-over groove connecting said at least one further groove with said sensor groove and a signal carrying cable coaxially connected to a piezoelectric sensor cable and positioned in said cross-over groove and said at least one further groove, said retaining means being a plastic shrink wrap envelope enclosing said lead strip, said piezoelectric sensor cables and said signal carrying coaxial cable and a roadway grade elastomeric envelope enclosing said plastic shrink wrap envelope, said lead strip, and said piezoelectric sensor.

20. In a linear roadway vehicle sensor having an electronic sensing cable for sensing vehicular traffic thereof, and a flat carrier, and a sensor groove in said carrier and an electronic sensor in said sensor groove, the improvement comprising, said carrier including flat linear malleable lead weight means distributed along the length of said carrier, and means for securing the lead weight means within a recess in said carrier, said flat linear malleable lead weight means causing said carrier to adapt to undulations and curvatures in the roadway and hug a roadway surface so that said sensor does not bounce and oscillate for a long period of time, said flat linear malleable lead weight means having a weight per unit length which is sufficient to maintain said sensor on said roadway and substantially immune to lifting from the roadway because of air flow effects and turbulence caused by vehicles.

21. The invention defined in claim 20 wherein said linear roadway vehicle sensor has a length sufficient to cross multiple lanes of roadway traffic and said flexible carrier member and said linear weight means are of corresponding length, an electronic sensing cable for each roadway, respectively, with all of said electronic sensing cables being carried in the same groove.

22. A roadway sensor for sensing vehicular traffic and a carrier for said sensor which is substantially immune to lifting from the roadway because of air flow turbulence caused by vehicles traveling at high speeds thereover, said carrier being a flexible carrier member for said linear roadway sensor and having at least one groove therein, said groove having an enlarged base for receiving said sensor and a pair of sidewalls which are spreadable apart sufficiently to allow said sensor to be snugly seated in said enlarged base, said flexible carrier member includes linear lead weight distributed along said flexible carrier member, said linear weight having a weight at least sufficient to render said flexible carrier member substantially immune to air effects generated by vehicular traffic on the roadway, and to cause said flexible carrier to hug the roadway surface and not be dangerous to moving traffic or pedestrians even if snagged or broken by vehicular traffic and means forming a cavity in said flexible carrier member for receiving said linear lead weight.

23. The invention defined in claim 22 wherein said carrier is an extruded, flat elastomeric member having upper and lower surfaces and a low vertical profile, said at least one groove being formed in said lower surface and said linear weight being a flat strip of lead having a low vertical profile.

24. The invention defined in claim 22 wherein said carrier is a flat elastomeric extrusion having upper and lower surfaces, a plurality of said grooves in one of said surfaces, and a plurality of said sensors carried by at least one of said grooves, and means for securing said lower surface to said linear lead weight.

25. A roadway sensor for sensing vehicular traffic and a carrier for said sensor which is substantially immune to lifting from the roadway because of air flow turbulence caused by vehicles traveling at high speeds thereover, said carrier having a centerline, an up-roadway edge relative to said centerline and being a flexible carrier member for said roadway sensor and having at least one sensor passage in said up-roadway edge, said flexible carrier member includes linear lead weight distributed along said flexible carrier member, said linear lead weight having a weight at least sufficient to render said flexible carrier member substantially immune to air effects generated by vehicular traffic on the roadway, and to cause said flexible carrier to adapt to undulations and curvatures in the roadway and hug the roadway surface and not bounce and oscillate or be dangerous to moving traffic or pedestrians even if snagged or broken by vehicular traffic and means forming a cavity in said flexible carrier member for receiving said linear lead weight.

26. The invention defined in claim 25 wherein said carrier is an extruded, flat elastomeric member having upper and lower surfaces and a low vertical profile, and a rectangular cavity formed in said carrier and said linear weight being a flat strip of lead having a low vertical profile and positioned in said cavity.

27. The invention defined in claim 25 wherein said carrier is a flat elastomeric extrusion, and includes a plurality of said sensors carried in said sensor passage.

* * * * *